US008394237B2

(12) United States Patent
Klein et al.

(10) Patent No.: US 8,394,237 B2
(45) Date of Patent: Mar. 12, 2013

(54) METHOD FOR MANUFACTURING PAPER, CARDBOARD AND PAPERBOARD USING ENDO-BETA-1,4-GLUCANASES AS DEWATERING MEANS

(75) Inventors: Torsten Klein, Speyer (DE); Christian Jehn-Rendu, Shanghai (CN); Hans-Georg Lemaire, Limburgerhof (DE); Oliver Koch, Wachenheim (DE)

(73) Assignee: BASF SE Ludwigshafen (DE)

( * ) Notice: Subject to any disclaimer, the term of this patent is extended or adjusted under 35 U.S.C. 154(b) by 83 days.

(21) Appl. No.: 13/058,874

(22) PCT Filed: Aug. 28, 2009

(86) PCT No.: PCT/EP2009/061098

§ 371 (c)(1), (2), (4) Date: Apr. 1, 2011

(87) PCT Pub. No.: WO2010/026101

PCT Pub. Date: Mar. 11, 2010

(65) Prior Publication Data

US 2011/0168344 A1 Jul. 14, 2011

(30) Foreign Application Priority Data

Sep. 2, 2008 (EP) ..... 08163465

(51) Int. Cl.
*D21H 11/00* (2006.01)

(52) U.S. Cl. ..... 162/164.6

(58) Field of Classification Search ..... 162/164.6, 162/174, 164.5, 168.2, 185
See application file for complete search history.

(56) References Cited

U.S. PATENT DOCUMENTS

| | | | |
|---|---|---|---|
| 4,144,123 | A | 3/1979 | Scharf |
| 4,421,602 | A | 12/1983 | Brunnmueller |
| 4,668,747 | A | 5/1987 | Cadel et al. |
| 4,753,710 | A | 6/1988 | Langley |
| 4,774,285 | A | 9/1988 | Pfohl |
| 5,167,766 | A | 12/1992 | Honig |
| 5,169,497 | A | 12/1992 | Sarkar et al. |
| 5,334,287 | A | 8/1994 | Hartmann |
| 5,393,381 | A | 2/1995 | Hund |
| 5,536,370 | A | 7/1996 | Scherr |
| 5,641,855 | A | 6/1997 | Scherr et al. |
| 5,688,874 | A | 11/1997 | Hoffman |
| 5,919,691 | A | 7/1999 | Oxenboell |
| 5,948,672 | A | 9/1999 | Rasmussen et al. |
| 5,981,689 | A | 11/1999 | Mitchell |
| 6,056,967 | A | 5/2000 | Steuerle |
| 6,087,448 | A | 7/2000 | Mitchell |
| 6,103,065 | A | 8/2000 | Humphreys |
| 6,121,409 | A | 9/2000 | Mitchell |
| 6,132,558 | A | 10/2000 | Dyllick-Brenzinger |
| 6,706,190 | B1 | 3/2004 | Steuerle |
| 7,034,068 | B1 | 4/2006 | Negele |
| 2002/0066540 | A1 | 6/2002 | Chen |
| 2003/0150575 | A1 | 8/2003 | Hund |
| 2003/0192664 | A1 | 10/2003 | Kulick |
| 2005/0070003 | A1 | 3/2005 | Schulein |
| 2006/0024262 | A1 | 2/2006 | Hahnle et al. |
| 2008/0196852 | A1 | 8/2008 | Leduc |
| 2008/0206836 | A1 | 8/2008 | Andersen et al. |
| 2010/0147475 | A1 | 6/2010 | Koch et al. |

FOREIGN PATENT DOCUMENTS

| | | | |
|---|---|---|---|
| DE | 2434816 | A1 | 2/1976 |
| DE | 3128478 | A1 | 2/1983 |
| DE | 10236252 | A1 | 5/2003 |
| DE | 10334133 | A1 | 2/2005 |
| DE | 10200405058587 | A1 | 6/2006 |
| DE | 102005043800 | A1 | 3/2007 |
| EP | 0176757 | A2 | 4/1986 |
| EP | 0216387 | A2 | 4/1987 |
| EP | 0235893 | A1 | 9/1987 |
| EP | 0374458 | A2 | 6/1990 |
| EP | 0462365 | A1 | 12/1991 |
| EP | 0524220 | A1 | 1/1993 |
| EP | 0536580 | A1 | 4/1993 |
| EP | 0910701 | A1 | 4/1999 |
| EP | 0937138 | A1 | 8/1999 |
| EP | 1328683 | A1 | 7/2003 |
| GB | 1509967 | A | 5/1978 |
| WO | 9117243 | A | 11/1991 |
| WO | 9412560 | A1 | 6/1994 |
| WO | 94/14873 | A1 | 7/1994 |
| WO | 96/11262 | A | 4/1996 |
| WO | 97/23567 | A1 | 7/1997 |
| WO | 9725367 | A1 | 7/1997 |
| WO | 97/38164 | A | 10/1997 |
| WO | 98/12307 | A1 | 3/1998 |
| WO | 99/63159 | A1 | 12/1999 |
| WO | 9966130 | A1 | 12/1999 |
| WO | 00/27893 | A1 | 5/2000 |
| WO | 00/63295 | A1 | 10/2000 |
| WO | 0067884 | A1 | 11/2000 |
| WO | 01/34910 | A1 | 5/2001 |
| WO | 02/33171 | A1 | 4/2002 |

OTHER PUBLICATIONS

English Language Abstract of DE 10236252 May 8, 2003.
English Language Abstract of WO 99/63159 Dec. 9, 1999.
English Language Abstract of WO 00/63295 Oct. 26, 2000.
English Language Translation/Abstract of EP 0524220 Jan. 27, 1993.
English Language Abstract of WO 99/66130 Dec. 23, 1999.

*Primary Examiner* — Mark Halpern
(74) *Attorney, Agent, or Firm* — Shruti Costales

(57) ABSTRACT

A process for the production of paper, board and cardboard by draining a paper stock on a wire in the presence of at least one cationic polymeric retention aid and/or retention aid system with sheet formation and drying of the sheets, wherein an endo-β-1,4-glucanase is metered in an amount of from 0.00001 to 0.01% by weight, based on the dry paper stock, into the paper stock before the addition of the at least one cationic polymeric retention aid and/or retention aid system.

13 Claims, No Drawings

METHOD FOR MANUFACTURING PAPER, CARDBOARD AND PAPERBOARD USING ENDO-BETA-1,4-GLUCANASES AS DEWATERING MEANS

This application is a 371 of PCT/EP2009/061098 filed 28 Aug. 2009.

The invention relates to a process for the production of paper, board and cardboard in the presence of at least one cationic polymeric retention aid and/or retention aid system using endo-β-1,4-glucanases as drainage aids, and to the papers produced by this process.

The use of drainage and retention aids in the production of paper, board and cardboard has long been known. Suitable retention aids are in particular cationic polymers, such as polyacrylamides, polyethylenimines, polyvinylamines, polydimethyldiallylammonium chloride and any mixtures thereof, but retention aid systems comprising at least one cationic polymer in combination with an organic and/or inorganic component are also known.

Cationic polyacrylamides are disclosed, for example, in EP 0 176 757 A2. These may be linear polyacrylamides but also branched polyacrylamides, as described in U.S. 2003/0150575 and in DE-A 10 2004 058 587 A1.

Polyethylenimines and modified polyethylenimines, as disclosed in DE-A 24 34 816, are also suitable as cationic polymeric retention aids. DE 24 34 816 and the literature cited there describe the reactions of polyethylenimine with crosslinking agents such as epichlorohydrin, reactions of polyethylenimine or other oligoamines with oligocarboxylic acids to give polyamidoamines, crosslinked products of these polyamidoamines and reactions of the polyamidoamines with ethylenimine and bifunctional crosslinking agents. Other modified polyethylenimines are disclosed in WO 00/67884 A1 and WO 97/25367 A1.

The use of polyvinylamines in the production of paper is disclosed, for example, in U.S. 2003/0192664, according to this document a polymer comprising vinylamine units and a particulate organic, crosslinked polymer being metered into an aqueous fiber slurry.

A further retention aid system which comprises cationic polyvinylamine is described in DE-A 10 2005 043 800 A1. There, a process for the production of paper is disclosed in which the retention aid system consists of (i) at least one polymer comprising vinylamine units (ii) at least one linear anionic polymer having a molar mass $M_w$ of at least 1 million and/or at least one branched, anionic, water-soluble polymer and/or a bentonite and/or silica gel and (iii) at least one particulate, anionic, crosslinked polymer having a mean particle diameter of at least 1 μm and an intrinsic viscosity of less than 3 dl/g.

Retention aid systems are also so-called microparticle systems which also comprise an organic and/or inorganic component in addition to at least one polymeric component. In general, the polymers such as modified polyethylenimines, polyacrylamides or polyvinylamines are added as flocculants to the microparticle systems, which polymers are further flocculated by subsequent addition of, for example, inorganic microparticles, such as bentonite or colloidal silica. The sequence of the addition of the components can also be reversed.

Such a microparticle system is disclosed in EP 0 235 893 A1. A process for the production of paper is described therein in which first a substantially linear synthetic polymer having a molar mass of more than 500 000 is added in an amount of more than 0.03% by weight, based on dry paper stock, to an aqueous fiber suspension, the mixture is then subjected to the action of a shear field and a bentonite is metered in after the last shear stage.

Another microparticle system is described in DE 102 36 252 A1. DE 102 36 252 A1 discloses a process for the production of paper, cationic polyacrylamides, polymers comprising vinylamine units and/or polydiallyldimethylammonium chloride having an average molar mass $M_w$ of in each case at least 500 000 dalton and a charge density of in each case not more than 4.0 meq/g being used as a cationic polymer of the microparticle system. The inorganic component as well as the cationic polymer is added to the fiber suspension before the last shear stage before the headbox. In addition, the retention aid system is free of polymers having a charge density of more than 4 meq/g.

Common to all combinations mentioned is that only the retention can be improved.

The literature also discloses the use of enzymes, in particular cellulases, as assistants in the production of paper.

EP 0 524 220 B1 discloses a process for the production of pulp in which cellulases are used for improving the draining of the pulp. The cellulases are metered into an at least 8% strength by weight stock preparation, and the stock preparation preferably has a proportion of 10-20% by weight of fibers. A disadvantage of this process is that only the drainage is improved.

A process for improving the draining of paper pulp with the use of a cellulase is also disclosed in EP 0 536 580 A1. According to this, first a cellulase is metered in an amount of at least 0.05% by weight, based on the dry paper stock, into the paper stock. The duration of contact of the cellulase with the paper stock is at least 20 minutes at a temperature of at least 20° C., before a water-soluble cationic polymer is then added in an amount of at least 0.007% by weight, based on the dry paper stock. A disadvantage of this process is that the cellulase must be used in large amounts in order to achieve a good drainage effect.

There is therefore a constant need in the paper industry for improved and novel paper assistants and paper assistant systems which improve the retention and drainage in equal measure.

It was therefore the object of the present invention to provide a process for the production of paper, board and cardboard with the use of a paper assistant system which results in improved retention and drainage.

The object was achieved by a process for the production of paper, board and cardboard by draining a paper stock on a wire in the presence of at least one cationic polymeric retention aid and/or retention aid system with sheet formation and drying of the sheets, wherein an endo-β-1,4-glucanase is metered in an amount of from 0.00001 to 0.01% by weight, based on the dry paper stock, into the paper stock before the addition of the at least one cationic polymeric retention aid and/or retention aid system.

In the process according to the invention, endo-β-1,4-glucanases are used as drainage aids in an amount of from 0.00001 to 0.01% by weight, based on the dry paper stock. The endo-β-1,4-glucanases are preferably used in an amount of from 0.00001 to 0.005% by weight, particularly preferably in the range from 0.00001 to 0.001% by weight, based in each case on the dry paper stock.

Endo-β-1,4-glucanases are enzymes which belong to the group consisting of the cellulases. These are involved in the hydrolysis of cellulose. For the hydrolysis of native cellulose, three main tapes of cellulases are known: endoglucanases, exoglucanases and β-glucosidases. Endo-β-1,4-glucanases which belong to the group consisting of the endoglucanases have the effect according to the invention.

Endoglucanases act randomly on soluble and insoluble cellulose chains. They are most reactive in the case of non-crystalline or amorphous cellulose, whereas they show very low reactivity toward crystalline cellulose. Examples of endo-β-1,4-glucanases (EC No. 3.2.1.4) are the commercial products Novozym® 476 from Novozymes and Polymin® PR 8336 from BASF SE. The commercial product Novozym® 476 from Novozymes has an activity of 4500 ECU/g according to the customary unit definition of Novozymes.

Endoglucanases are described in detail in WO 98/12307 A1 and the literature cited therein, which are expressly incorporated by reference at this point. In addition, modified endoglucanases are disclosed in EP 0 937 138 B1, which is likewise incorporated by reference at this point.

In general, cellulases are produced by a large number of microorganisms, such as, for example fungi, actinobacteria and myxobacteria, but also by plants. In particular endoglucanases from a broad range of species have been identified to date. For commercial use, they are generally isolated from cultures of microscopic fungi of the genus *Trichoderma* (e.g. *T. reesei*), which occur in the soil and are included among the deuteromycetes (Fungi imperfecti).

The endo-β-1,4-glucanase can be metered both into the high-consistency stock and into the low-consistency paper stock. The high-consistency stock usually has a consistency of more than 2% by weight, for example from 2.5 to 6% by weight, preferably from 3.0 to 4.5% by weight, based in each case on the dry paper stock. The high-consistency stock is then converted by addition of water into the so-called low-consistency stock, which has a consistency below 1.5% by weight, based on the dry paper stock. In general, the consistency of the low-consistency stock is below 1.2% by weight, for example from 0.5 to 1.1% by weight, preferably from 0.6 to 0.9% by weight, based in each case on the dry paper stock.

In a preferred embodiment of the process according to the invention, the endo-β-1,4-glucanase is metered into the high-consistency paper stock.

It is essential to the invention that the metering of the endo-β-1,4-glucanase be effected before the addition of the at least one cationic polymeric retention aid and/or retention aid system.

Suitable cationic polymeric retention aids are in particular cationic polymers, such as polyacrylamides, polyethylenimines, polyvinylamines and polydimethyldiallylammonium chloride and any mixtures thereof. Retention aid systems in the context of this invention consist of at least one of said cationic polymers in combination with an organic and/or inorganic component.

Linear, branched or crosslinked polyacrylamides can be used as cationic polymeric retention aids in the process according to the invention. Cationic polyacrylamides are, for example, copolymers which are obtainable by copolymerization of acrylamide and at least one di-$C_1$- to $C_2$-alkylamino-$C_2$- to $C_4$-alkyl (meth)acrylate or a basic acrylamide in the form of the free bases, the salts with organic or inorganic acids or the compounds quarternized with alkyl halides. Examples of such compounds are dimethylaminoethyl methacrylate, diethylaminoethyl methacrylate, dimethylaminoethyl acrylate, diethylaminoethyl acrylate, dimethylaminopropyl methacrylate, dimethylaminopropyl acrylate, diethylaminopropyl methacrylate, diethylaminopropyl acrylate and/or dimethylaminoethylacrylamide. Further examples of cationic polyacrylamides appear in the literature mentioned in connection with the prior art, such as EP 0 910 701 A1 and U.S. Pat. No. 6,103,065. It is possible to use both linear and branched or crosslinked polyacrylamides. Such polymers are commercially available products.

Branched polymers which can be prepared, for example, by copolymerization of acrylamide or methacrylamide with at least one cationic monomer in the presence of small amounts of crosslinking agents are described, for example, in the literature U.S. Pat. No. 5,393,381, WO 99/66130 A1 and WO 99/63159 A1 mentioned in connection with the prior art. Further branched cationic polyacrylamides are disclosed as component (b) in DE 10 2004 058 587 A1, which is expressly incorporated by reference at this point.

In practice, the branched or crosslinked (co)polyacrylamide is preferably a cationic copolymer of acrylamide and an unsaturated cationic ethylene monomer which is selected from dimethylaminoethyl acrylate (ADAME), dimethylaminoethylacrylamide, dimethylaminoethyl methacrylate (MADAME), which are quarternized or made salt-forming by various acids and quarternizing agents, such as benzyl chloride, methyl chloride, alkyl or aryl chloride, dimethyl sulfate, and furthermore dimethyldiallylammonium chloride (DADMAC), acrylamidopropyltrimethylammonium chloride (APTAC) and methacrylamidopropyltrimethylammonium chloride (MAPTAC). Preferred cationic comonomers are dimethylaminoethyl acrylate methochloride and dimethylaminoethylacrylamide methochloride, which are obtained by alkylation of dimethylaminoethyl acrylate or dimethylaminoethylacrylamide with methyl chloride.

This copolymer is branched in a manner known to the person skilled in the art by a branching agent which consists of a compound which has at least two reactive groups which are selected from the group comprising double bonds, aldehyde bonds or epoxy bonds. These compounds are known and are described, for example, in the publication EP 0 374 458 A1.

In the process according to the invention, it is of course possible also to use branched cationic polyacrylamides which consist of a mixture of branched and linear polyacrylamides as described in the prior art. Such a mixture consists as a rule of a branched cationic polyacrylamide as described above and a linear polyacrylamide in a ratio of from 99:1 to 1:2, preferably in the ratio of from 90:1 to 2:1 and particularly preferably in the ratio of from 90:1 to 3:1.

The cationic polyacrylamide may also be crosslinked, the polymerization of the monomers being carried out in the presence of a customary crosslinking agent. It is known that crosslinking agents are compounds which comprise at least two ethylenically unsaturated double bonds in the molecule, such as methylenebisacrylamide, pentaerythrityl triacrylate or glycol diacrylates.

In the process according to the invention, it is of course also possible to use mixtures of linear, branched and crosslinked polyacrylamides, but preferably only one polyacrylamide is used.

Usually, the polyacrylamides which can be used in the process according to the invention have an intrinsic viscosity of at least 2 dl/g. The intrinsic viscosity is determined according to ISO 1628/1, October 1988, "Guidelines for the standardization of methods for the determination of viscosity number and limiting viscosity number of polymers in dilute solution". The intrinsic viscosity is preferably in the range from 2 to 20 dl/g, particularly preferably in the range from 7 to 15 dl/g.

Furthermore, polyethylenimines are suitable as cationic polymeric retention aids. In the context of the present invention, these may be in particular the following polyethylenimines or modified polyethylenimines:

a) The nitrogen-containing condensates described in DE-A 24 34 816. These are obtained by reacting polyamidoamine compounds with polyalkylene oxide derivatives which are reacted at the terminal hydroxyl groups with epichlorohydrin. The reaction is carried out by reacting (i) one part by weight of a polyamidoamine which has been obtained from 1 molar part of a dicarboxylic acid having 4 to 10 carbon atoms and from 0.8 to 1.4 molar parts of a polyalkylenepolyamine having 3 to 10 alkylenimine units and comprising, if appropriate, up to 10% by weight of a diamine and which, if appropriate, comprises up to 8 grafted-on ethylenimine units per basic nitrogen group with (ii) from 0.3 to 2 parts by weight of a polyalkylene oxide derivative which has been reacted at the terminal OH groups with at least equivalent amounts of epichlorohydrin, at from 20 to 100° C., and continuing the reaction until the formation of high molecular weight resins which are just water-soluble and have a viscosity of >300 mPas (measured on a Brookfield viscometer in 20% strength aqueous solution at 20° C.).

For the preparation of such condensates, reference is made expressly and in its entirety to the disclosure of DE 24 34 816, in particular to the passage on page 4, 3$^{rd}$ paragraph to page 6 inclusive.

b) The reaction products of alkylenediamines or polyalkylenepolyamines with crosslinking agents comprising at least two functional groups, which reaction products are described, for example, in WO 97/25367 A1. Polyethylenimines obtainable in this manner have as a rule a broad molar mass distribution and average molar masses $M_w$ of, for example, from 120 to $2\cdot10^6$, preferably from 430 to $1\cdot10^6$. This group also includes polyamidoamines grafted with ethylenimine and crosslinked with bisglycidyl ethers of polyethylene glycols and described in U.S. Pat. No. 4,144,123.

c) Reaction products which are obtainable by reacting Michael adducts of polyalkylenepolyamines, polyamidoamines, polyamidoamines grafted with ethylenimine and mixtures of said compounds and monoethylenically unsaturated carboxylic acids, salts, esters, amides or nitriles with at least bifunctional crosslinking agents. Such reaction products are disclosed, for example, in WO 94/184743 A1. In addition to the halogen-containing crosslinking agents, the classes of halogen-free crosslinking agents described are suitable for their preparation.

d) Water-soluble, crosslinked, partly amidated polyethylenimines which are disclosed in WO 94/12560 A1 and are obtainable by reacting polyethylenimines with monobasic carboxylic acids or their esters, anhydrides, acid chlorides or acid amides with amide formation and reacting amidated polyethylenimines with crosslinking agents comprising at least two functional groups.

The average molar masses $M_w$ of the suitable polyethylenimines may be up to 2 million and are preferably in the range from 1000 to 50 000. The polyethylenimines are partly amidated with monobasic carboxylic acids so that for example, from 0.1 to 90, preferably from 1 to 50, % of the amidatable nitrogen atoms in the polyethylenimines are present as an amido group. Suitable, at least bifunctional crosslinking agents comprising double bonds are mentioned above. Halogen-free crosslinking agents are preferably used.

e) Polyethylenimines and quarternized polyethylenimines. For example, both homopolymers of ethylenimine and polymers which comprise, for example, grafted-on ethylenimine (aziridine) are suitable for this purpose. The homopolymers are prepared, for example, by polymerization of ethylenimine in aqueous solution in the presence of acids, Lewis acids or alkylating agents, such as methyl chloride, ethyl chloride, propyl chloride, ethylene chloride, chloroform or tetrachloroethylene. The polyethylenimines thus obtainable have a broad molar mass distribution and average molar masses $M_w$, of, for example, from 120 to $2\cdot10^6$, preferably from 430 to $1\cdot10^6$.

The polyethylenimines and the quarternized polyethylenimines can, if appropriate, be reacted with a crosslinking agent comprising at least two functional groups (see above). The quarternization of the polyethylenimines can be carried out, for example, with alkyl halides, such as methyl chloride, ethyl chloride, hexyl chloride, benzyl chloride or lauryl chloride, and with, for example, dimethyl sulfate. Further suitable modified polyethylenimines are polyethylenimines modified by Strecker reaction, for example the reaction products of polyethylenimines with formaldehyde and sodium cyanide with hydrolysis of the resulting nitriles to give the corresponding carboxylic acids. These products can, if appropriate, be reacted with a crosslinking agent comprising at least two difunctional groups (see above).

Also suitable are phosphonomethylated polyethylenimines and alkoxylated polyethylenimines, which are obtainable, for example, by reacting polyethylenimine with ethylene oxide and/or propylene oxide and are described in WO 97/25367 A1. The phosphonomethylated and the alkoxylated polyethylenimines can, if appropriate, be reacted with a crosslinking agent comprising at least two functional groups (see above).

f) Further amino group-containing polymers in the context of the present invention are all polymers which are mentioned under a) to e) and which are subsequently subjected to an ultrafiltration as described in WO 00/67884 A1 and WO97/23567 A1.

The amino group-containing polymers or modified polyethylenimines are preferably selected from polyalkylenimines, polyalkylenepolyamines, polyamidoamines, polyalkylene glycol polyamines, polyamidoamines grafted with ethylenimine and then reacted with at least bifunctional crosslinking agents and mixtures and copolymers thereof. Polyalkylenimines, in particular polyethylenimines, and the derivatives thereof are preferred. Polyamidoamines grafted with ethylenimine and then reacted with at least bifunctional crosslinking agents are particularly preferred.

In particular, the abovementioned amino group-containing polymers are selected from the polymers described in DE 24 34 816 and the ultrafiltered amino group-containing polymers described in WO 00/67884 A1. Reference is hereby made to these publications in their entirety.

In addition, polyvinylamines and polymers comprising vinylamine units are suitable as cationic polymeric retention aids.

Polymers comprising vinylamine units are known, cf. U.S. Pat. No. 4,421, 602, 5,334,287, EP 0 216 387 A1, U.S. Pat. No. 5,981,689, WO 00/63295 A1, U.S. Pat. No. 6,121,409 and 6,132,558. They are prepared by hydrolysis of open-chain polymers comprising N-vinylcarboxamide units. These polymers are obtainable, for example, by polymerization of N-vinylformamide, N-vinyl-N-methylformamide, N-vinylacetamide, N-vinyl-N-methylacetamide, N-vinyl-N-ethylacetamide and N-vinylpropionamide. Said monomers can be polymerized either alone or together with other monomers. N-vinylformamide is preferred.

Suitable monoethylenically unsaturated monomers which are copolymerized with the N-vinylcarboxamides are all compounds copolymerizable therewith. Examples of these are vinyl esters of saturated carboxylic acids of 1 to 6 carbon atoms, such as vinyl formate, vinyl acetate, N-vinylpyrrolidone, vinyl propionate and vinyl butyrate, and vinyl ethers, such as $C_1$- to $C_6$-alkyl vinyl ethers, e.g. methyl or ethyl vinyl ethers. Further suitable comonomers are esters of alcohols having, for example, 1 to 6 carbon atoms, amides and nitriles of ethylenically unsaturated $C_3$- to $C_6$-carboxylic acids, for example methyl acrylate, methyl methacrylate, ethyl acrylate, ethyl methacrylate and dimethyl maleate, acrylamide and methacrylamide and acrylonitrile and methacrylonitrile.

Further suitable carboxylic esters are derived from glycols or polyalkylene glycols, in each case only one OH group being esterified, e.g. hydroxyethyl acrylate, hydroxyethyl methacrylate, hydroxypropyl acrylate, hydroxybutyl acrylate, hydroxypropyl methacrylate, hydroxybutyl methacrylate and monoesters of acrylic acid with polyalkylene glycols having a molar mass of from 500 to 10 000. Further suitable comonomers are esters of ethylenically unsaturated carboxylic acids with aminoalcohols, such as, for example, dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. The basic acrylates can be used in the form of the free bases, of the salts with mineral acids, such as hydrochloric acid, sulfuric acid or nitric acid, of the salts with organic acids, such as formic acid, acetic acid, propionic acid, or of the sulfonic acids or in quarternized form. Suitable quarternizing agents are, for example, dimethyl sulfate, diethyl sulfate, methyl chloride, ethyl chloride or benzyl chloride.

Further suitable comonomers are amides of ethylenically unsaturated carboxylic acids, such as acrylamide, methacrylamide and N-alkylmono- and diamides of monoethylenically unsaturated carboxylic acids having alkyl radicals of 1 to 6 carbon atoms, e.g. N-methylacrylamide, N,N-dimethylacrylamide, N-methylmethacrylamide, N-ethylacrylamide, N-propylacrylamide and tert-butylacrylamide, and basic (meth)acrylamides, such as, for example, dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Other suitable comonomers are N-vinylpyrrolidone, N-vinylcaprolactam, acrylonitrile, methacrylonitrile, N-vinylimidazole and substituted N-vinylimidazoles, such as, for example, N-vinyl-2-methylimidazole, N-vinyl-4-methylimidazole, N-vinyl-5-methylimidazole, N-vinyl-2-ethylimidazole, and N-vinylimidazolines, such as N-vinylimidazoline, N-vinyl-2-methylimidazoline and N-vinyl-2-ethylimidazoline. N-vinylimidazoles and N-vinylimidazolines are used not only in the form of the free bases but also in a form neutralized with mineral acids or organic acids or in quarternized form, the quarternization preferably being carried out with dimethyl sulfate, diethyl sulfate, methyl chloride or benzyl chloride. Diallyldialkylammonium halides, such as, for example, diallyldimethylammonium chloride, are also suitable.

The copolymers comprise, for example,

- from 95 to 5 mol %, preferably from 90 to 10 mol %, of at least one N-vinylcarboxamide, preferably N-vinylformamide, and
- from 5 to 95 mol %, preferably 10 to 90 mol % of monoethylenically unsaturated monomers incorporated in the form of polymerized units. The comonomers are preferably free of acid groups.

The polymerization of the monomers is usually carried out in the presence of free radical polymerization initiators. The homo- and copolymers can be obtained by all known processes; for example, they are obtained by solution polymerization in water, alcohols, ethers or dimethylformamide or in mixtures of different solvents, by precipitation polymerization, inverse suspension polymerization (polymerization of an emulsion of a monomer-containing aqueous phase in an oil phase) and polymerization of a water-in-water emulsion, for example in which an aqueous monomer solution is dissolved or emulsified in an aqueous phase and polymerized with formation of an aqueous dispersion of a water-soluble polymer, as described, for example, in WO 00/27893 A1. After the polymerization, the homo- and copolymers which comprise N-vinylcarboxamide units incorporated in the form of polymerized units are partly or completely hydrolyzed as described below.

In order to prepare polymers comprising vinylamine units, it is preferably to start from homopolymers of N-vinylformamide or from copolymers which are obtainable by copolymerization of

- N-vinylformamide with
- vinyl formate, vinyl acetate, vinyl propionate, acrylonitrile, methyl acrylate, ethyl acrylate and/or methyl methacrylate and subsequent hydrolysis of the homopolymers or of the copolymers with formation of vinylamine units from the N-vinylformamide units incorporated in the form of polymerized units, the degree of hydrolysis being, for example, from 1 to 100 mol %, preferably from 25 to 100 mol %, particularly preferably from 50 to 100 mol % and especially preferably from 70 to 100 mol %. The degree of hydrolysis corresponds to the content of vinylamine groups in mol % in the polymers. The hydrolysis of the polymers described above is effected by known processes by the action of acids (e.g. mineral acids, such as sulfuric acid, hydrochloric acid or phosphoric acid, carboxylic acids, such as formic acid or acetic acid, or sulfonic acids or phosphonic acids), bases or enzymes, as described, for example, in DE-A 31 28 478 and U.S. Pat. No. 6,132,558. With the use of acids as hydrolysis agents, the vinylamine units of the polymers are present as an ammonium salt while the free amino groups form on hydrolysis with bases.

In most cases, the degree of hydrolysis of the homo- and copolymers used is from 85 to 95 mol %. The degree of hydrolysis of the homopolymers is equivalent to the content of vinylamine units in the polymers. In the case of copolymers which comprise vinyl esters incorporated in the form of polymerized units, hydrolysis of the ester groups with formation of vinyl alcohol units may occur in addition to the hydrolysis of the N-vinylformamide units. This is the case in particular when the hydrolysis of the copolymers is carried out in the presence of sodium hydroxide solution. Acrylonitrile incorporated in the form of polymerized units is likewise chemically modified during the hydrolysis. For example, amido groups or carboxyl groups form thereby. The homo- and copolymers comprising vinylamine units can, if appropriate, comprise up to 20 mol % of amidine units, which forms, for example, by reaction of formic acid with two neighboring amino groups or by intramolecular reaction of an amino group with a neighboring amido group, for example of N-vinylformamide incorporated in the form of polymerized units.

The average molar masses $M_w$ of the polymers comprising vinylamine units are, for example from 500 to 10 million, preferably from 750 to 5 million and particularly preferably from 1000 to 2 million g/mol (determined by light scattering).

This molar mass range corresponds, for example, to K values of from 30 to 150, preferably from 60 to 100 (determined according to H. Fikentscher in 5% strength aqueous sodium chloride solution at 25° C., a pH of 7 and a polymer concentration of 0.5% by weight). Polymers which comprise vinylamine units and have K values of from 85 to 95 are particularly preferably used.

The polymers comprising vinylamine units have, for example, a charge density (determined at pH 7) of from 0 to 18 meq/g, preferably from 5 to 18 meq/g and in particular from 10 to 16 meq/g.

The polymers comprising vinylamine units are preferably used in salt-freeform. Salt-free aqueous solutions of polymers comprising vinylamine units can be prepared, for example, from the salt-containing polymer solutions described above with the aid of ultrafiltration over suitable membranes with cut-offs of, for example, from 1000 to 500 000 dalton, preferably from 10 000 to 300 000 dalton.

Derivatives of polymers comprising vinylamine units can also be used as creping assistants. It is thus possible to prepare a multiplicity of suitable derivatives, for example, from the polymers comprising vinylamine units by amidation, alkylation, sulfonamide formation, urea formation, thiourea formation, carbamate formation, acylation, carboxymethylation, phosphonomethylation or Michael addition of the amino groups of the polymer. Of particular interest here are non-crosslinked polyvinylguanidines, which are obtainable by reaction of polymers comprising vinylamine units, preferably polyvinylamines, with cyanamide ($R^1R^2N$—CN, where $R^1$, $R^2$ are H, $C_1$- to $C_4$-alkyl, $C_3$- to $C_6$-cycloalkyl, phenyl, benzyl, alkyl-substituted phenyl or naphthyl), cf. U.S. Pat. No. 6,087,448, column 3, line 64 to column 5, line 14.

The polymers comprising vinylamine units also include hydrolyzed graft polymers of, for example, N-vinylformamide on polyalkylene glycols, polyvinyl acetate, polyvinyl alcohol, polyvinylformamides, polysaccharides, such as starch, oligosaccharides or monosaccharides. The graft polymers are obtainable by subjecting, for example, N-vinylformamide to free radical polymerization in an aqueous medium in the presence of at least one of said grafting bases, if appropriate together with copolymerizable other monomers, and then hydrolyzing the grafted-on vinylformamide units in a known manner to give vinylamine units.

Preferred polymers comprising vinylamine units are vinylamine homopolymers of N-vinylformamide having a degree of hydrolysis of from 1 to 100 mol %, preferably from 25 to 100 mol %, and copolymers of N-vinylformamide and vinyl formate, vinyl acetate, vinyl propionate, acrylonitrile, methyl acrylate, ethyl acrylate and/or methyl methacrylate hydrolyzed to a degree of from 1 to 100 mol %, preferably from 25 to 100 mol %, and having K values of from 30 to 150, in particular from 60 to 100. In the process according to the invention, the abovementioned homopolymers of N-vinylformamide are particularly preferably used.

Further suitable cationic polymeric retention aids are polydiallyldimethylammonium chlorides (PolyDADMAC), preferably having an average molar mass of at least 500 000 dalton, preferably at least 1 million dalton. Polymers of this type are commercial products.

Of course, said cationic polymeric retention aids can be used alone or as any mixture with one another in the process according to the invention. Preferably, only one cationic polymeric retention aid is used.

In a preferred embodiment of the process according to the invention, the cationic polymeric retention aid is selected from the group consisting of the polyacrylamides and polyvinylamines.

Usually, the at least one cationic polymeric retention aid is metered in an amount of from 0.001 to 0.1, preferably from 0.03 to 0.5, % by weight, based in each case on the dry paper stock.

Furthermore, retention aid systems as disclosed in the prior art can be used in the process according to the invention. These retention aid systems consist of said cationic polymers and a further organic and/or inorganic component.

A retention aid system comprising a further organic component which is suitable in the process according to the invention also comprises, in addition to one of the abovementioned cationic polymers, a water-insoluble, anionic, organic component which has a diameter of less than 750 nm when crosslinked and a diameter of less than 60 nm when uncrosslinked. This anionic component is preferably an anionic, crosslinked polyacrylamide. Such a system is described in EP 0 462 365 A1. Such a system can optionally also comprise an inorganic component as described below.

A retention aid system in which the organic component is an anionic polymer, such as, preferably, a polyacrylamide, is furthermore suitable. This polyacrylamide may be linear, branched or crosslinked. Such a system comprising cationic polymer, anionic, branched polymer and inorganic component is described, for example, in EP 1 328 683 A1. Similar retention aid systems are described in WO 02/33171 A1, an anionic, crosslinked polyacrylamide being used here as organic components. Also suitable is the retention system which is disclosed in WO 01/34910 A1 and comprises an anionic, linear polyacrylamide as the organic component.

So-called microparticle systems in which an inorganic component is metered into the paper stock together with said cationic polymers are preferred. This inorganic component is preferably bentonite and/or silica gel. Bentonites are finely divided minerals swellable in water, such as, for example, bentonite itself, hectorite, attapulgite, montmorillonite, nontronite, saponite, sauconite, hormite and sepiolite. For example, modified and unmodified silicic acids are suitable as silica gel. Bentonite and/or silica gel are usually used in the form of an aqueous slurry. If a microparticle system with an inorganic component is used in the process according to the invention, the amount is from 0.05 to 0.5, preferably from 0.1 to 0.3, % by weight, based in each case on the dry paper stock, in the case of bentonite and usually from 0.005 to 0.5, preferably from 0.01 to 0.3, % by weight, calculated on the basis of the $SiO_2$ fraction in the silica gel and based in each case on the dry paper stock, in the case of silica gel.

If a microparticle system is used in the process according to the invention, the inorganic component can be metered into the paper stock both before and after the last shear stage before the headbox. The metering is preferably effected before the last shear stage before the headbox.

In the process according to the invention, a considerably improved drainage in combination with equally good retention is surprisingly obtained compared with the use of cationic polymeric retention aids and/or retention aid systems. The use of endo-β-1,4-glucanases in a lower dose compared with the prior art, in combination with the use of retention aids and retention aid systems, leads to a substantial improvement in the drainage properties.

The invention also relates to the papers produced by the process according to the invention.

All paper stocks can be processed by the process according to the invention. It is possible, for example, to start from cellulose fibers of all types, both from natural and from recovered fibers, in particular from fibers from waste paper. Suitable fibers for the production of the pulps are all qualities customary for this purpose, e.g. mechanical pulp, bleached and unbleached chemical pulp and paper stocks from all annual plants. Mechanical pulps include, for example, groundwood, thermomechanical pulp (TMP), chemothermomechanical pulp (CTMP), pressure groundwood, semichemical pulp, high-yield pulp and refiner mechanical pulp (RMP). For example, sulfate, sulfite and soda pulps are suitable as chemical pulp. Unbleached chemical pulp, which is also referred to as unbleached kraft pulp, is preferably used. Suitable annual plants for the production of paper stocks are, for example, rice, wheat, sugarcane and kenaf. For the production of the pulps, waste paper or waste cardboard, which is used either alone or as a mixture with other fibers, can also advantageously be used or fiber mixtures comprising a primary stock and recycled coated waste, for example bleached pine sulfate mixed with recycled coated waste, are used as starting material.

In the process according to the invention, the endo-β-1,4-glucanases are added as a drainage aid to the paper stock before the addition of the cationic polymeric retention aid and/or retention aid system. Of course, the customary process chemicals for the production of paper and paper products can additionally be used in the process according to the invention. Customary process chemicals are, for example, additives such as starch, pigments, optical brighteners, dyes, biocides, strength agents for paper, sizes, fixing agents, antifoams and deaerators. Said additives are used in the otherwise customary amounts known to the person skilled in the art. Starch used may be, for example, all starch varieties, such as native starches or modified starches, in particular cationically modified starches. Suitable fixing agents are, for example, optionally modified polyethylenimines, polydimethyldiallylammonium chloride, dicyandiamide resins, condensates crosslinked with epichlorohydrin and obtained from a dicarboxylic acid and a polyamine, polyaluminum chloride, aluminum sulfate and polyaluminum chlorosulfate. Suitable sizes are, for example, rosin, alkyldiketenes, alkenylsuccinic anhydrides or polymeric sizes and mixtures thereof.

In particular, the use of strength agents for paper is advantageous in the process according to the invention. Suitable strength agents are also, for example, the abovementioned polyvinylamines or polymers comprising vinylamine units, which are usually used in an amount of from 0.01 to 0.5, preferably from 0.1 to 0.3, % by weight, based in each case on the dry paper stock. Other suitable strength agents are so-called carrier systems, which are fillers treated with amphoteric polymers, such as calcium carbonate. Such carrier systems are disclosed, for example, in DE-A 10 334 133 A1.

The invention is explained in more detail by the following, nonlimiting examples.

The stated percentages in the examples are percent by weight, unless evident otherwise from the context. The dose of the individual components enzyme, polymer, fixing agent and bentonite is stated in % by weight and is based on the dry amount of the respective component per tonne of paper.

The following components were used in the examples:

Enzyme A: endo-β-1,4-glucanase (Polymin® PR 8336 from BASF SE)

Polymer A: high molecular weight cationic polyacrylamide emulsion having a molecular weight of about 5 000 000, a charge density of 1.8 meq/g and an intrinsic viscosity of 10.5 dl/g (Polymin® KE 440 from BASF SE)

Fixing agent A: low molecular weight polyethylenimine having a molecular weight of about 800 000 and a charge density of about 11 meq/g (Catiofast® SF from BASF SE)

Bentonite: Microfloc® XFB from BASF SE

The retention effect (total retention FPR) was determined using a Britt jar.

The drainage time was determined according to ISO standard 5267 using a Schopper-Riegler tester by draining therein in each case 1 l of the fiber slurry to be tested, having a consistency of 2 g/l, and determining the time in seconds which was necessary for the passage of 600 ml of filtrate. The examples state the improvement in the drainage time in % which results from the formula [1-(drainage time (experiment)/drainage time(comparison)]×100.

An SZP-06 zeta potential system from Mütek was used for determining the zeta potential (surface charge of fibers).

The water retention value (WRV) was determined by an empirical measurement of the water absorption capacity of a fiber mat. For this purpose, 2.50 ml of a 4% strength by weight fiber slurry was introduced into an anion exchange extraction column which comprises a glass frit at about half height (from Merck, SAX, 1.02025.0001 or from Strata, C8, 8B-S005-HBJ). Thereafter, the suspension was centrifuged at 3000 g for 15 minutes. The moist fiber mat was removed from the screen and weighed (weight W1). Thereafter, the fiber mat was dried to constant mass at 105° C. and weighed again (weight W2). The WRV was stated in the examples in % and is obtained from the formula (W1−W2)/W2×100.

EXAMPLE 1

A 1% strength by weight stock suspension comprising 100% of waste paper (old corrugated container) was introduced into a 2 l beaker. A 3% strength by weight stock suspension comprising 100% of waste paper (old corrugated container) was introduced into a second 2 l beaker. The pH of the stock suspensions was, if required, adjusted to pH 7.5 with an aqueous sodium hydroxide solution or with hydrochloric acid. Thereafter, the amounts of enzyme A which are stated in Table 1 were added to the various stock suspensions and stirred with the aid of a Heiltof stirrer at 800 revolutions per minute (rpm) for one hour at a temperature of 55° C. After this treatment, the stock suspensions were diluted with water to a consistency of 2 g/l and the drainage time was determined.

For comparison, the drainage time of 1 and 3% strength by weight stock suspensions which were subjected to the same treatment but comprised no enzyme A was determined in each case as a comparative value. The results are summarized in Table 1.

TABLE 1

Improvement of the drainage time at various enzyme concentrations as a function of the initial consistency

| Test No. | Enzyme A [% by weight] | Improvement of the drainage time [%], 1% strength by weight stock suspension | Improvement of the drainage time [%], 3% strength by weight stock suspension |
|---|---|---|---|
| 1 | 0.001 | 2.41 | 11.11 |
| 2 | 0.005 | 7.23 | 19.75 |
| 3 | 0.01 | 13.25 | 25.93 |
| 4 | 0.05 | 21.69 | 32.10 |
| 5 | 0.1 | 22.89 | 35.80 |
| 6 | 0.3 | 26.51 | 38.27 |
| 7 | 0.5 | 32.53 | 43.21 |

Table 1 shows that the efficiency of the enzyme is substantially better at an initial consistency of 3% by weight.

EXAMPLE 2

Example 1 was repeated but only 1% strength by weight stock suspensions were used. After addition of the enzyme, said stock suspensions were stirred with the aid of a Heiltof stirrer at different stirring speeds (250 rpm or 800 rpm). The further treatment was effected as in example 1. The drainage time was then determined.

For comparison, the drainage time of a 1% strength by weight stock suspension which was subjected to the same treatment but comprised no enzyme A was determined in each case as a comparative value. The results are summarized in Table 2.

TABLE 2

Improvement of the drainage time at various enzyme concentrations as a function of the stirring speed (initial consistency 1% by weight)

| Test No. | Enzyme A [% by weight] | Improvement of the drainage time [%], 250 rpm | Improvement of the drainage time [%], 800 rpm |
|---|---|---|---|
| 8 | 0.005 | 23.91 | 7.23 |
| 9 | 0.01 | 28.26 | 13.25 |
| 10 | 0.05 | 31.52 | 21.69 |
| 11 | 0.1 | 34.78 | 22.89 |
| 12 | 0.3 | 39.13 | 26.51 |
| 13 | 0.5 | 43.48 | 32.53 |

Table 2 shows that a reduction of the stirring speed leads to a higher efficiency of the enzyme.

EXAMPLE 3

Example 1 was repeated but only 3% strength by weight stock suspensions were used. After addition of the enzyme, said stock suspensions were stirred with the aid of a Heiltof stirrer at different stirring speeds (250 rpm or 800 rpm). The further treatment was effected as in example 1. The drainage time was then determined.

For comparison, the drainage time of a 3% strength by weight stock suspension which was subjected to the same treatment but comprised no enzyme A was determined in each case as a comparative value. The results are summarized in Table 3.

TABLE 3

Improvement of the drainage time at various enzyme concentrations as a function of the stirring speed (initial consistency 3% by weight)

| Test No. | Enzyme A [% by weight | Improvement of the drainage time [%], 250 rpm | Improvement of the drainage time [%], 800 rpm |
|---|---|---|---|
| 14 | 0 001 | 34.12 | 11.11 |
| 15 | 0.005 | 42.35 | 19.75 |
| 16 | 0.01 | 44.71 | 25.93 |
| 17 | 0.05 | 45.88 | 32.10 |
| 18 | 0.1 | 45.88 | 35.80 |
| 19 | 0.3 | 47.06 | 38.27 |
| 20 | 0.5 | 48.24 | 43.21 |

It is found that the reduction of the stirring speed in combination with an increased initial consistency leads to a substantial increase in the efficiency of the enzyme.

EXAMPLE 4

A 6% strength by weight stock suspension comprising 100% waste paper (old corrugated container) was introduced into a 2 l beaker. The pH of the stock suspension was, if required, adjusted to pH 7.5 with an aqueous sodium hydroxide solution or hydrochloric acid. Thereafter, the amounts of enzyme A which are stated in Table 4 were added and stirred with the aid of a Heiltof stirrer at 250 rpm for one hour at 55° C. After this treatment, 500 ml of this stock suspension were removed and diluted with water to a consistency of 0.5% by weight.

The zeta potential of this dilute stock suspension was determined. In addition, the retention effect (total retention FPR) of this dilute stock suspension was determined using a Britt jar and the chemical oxygen demand (COD) of the white water (filtrate) was determined, the following time sequence being maintained:

t=0 s start of the stirrer t=10 s optional addition of 0.03% by weight of polymer A t=30 s removal of 100 ml of the suspension for measuring the retention effect (FPR) or the chemical oxygen demand (COD) of the white water (filtrate)

For comparison, the zeta potential, the retention effect (FPR) and the chemical oxygen demand (COD) of a stock suspension which were subjected to the same treatment but to which 0.46% by weight of the enzyme Celluclast® 1.5 L (from Novozymes, corresponding to EP 536 580 A) were added was determined. The results are summarized in Table 4.

TABLE 4

Zeta potential, retention effect (FPR) and chemical oxygen demand (COD)

| Enzyme [% by weight] | Zeta potential [mV] | COD without addition of polymer A [μeq/l] | COD with addition of polymer A [μeq/l] | FPR without addition of polymer A [%] | FPR with addition of polymer A [%] |
|---|---|---|---|---|---|
| Enzyme A, 0 | −23.6 | 142 | 31.1 | 73.9 | 82.2 |
| Enzyme A, 0.0001 | −24.4 | 186 | 154 | 77.9 | 81.5 |
| Enzyme A, 0 0003 | −25.0 | 221 | 186 | 77.9 | 78.8 |
| Enzyme A, 0.01 | −24.9 | 293 | 257 | 75.7 | 79.0 |
| Enzyme A, 0.03 | −24.8 | 413 | 312 | 75.4 | 78.9 |
| Enzyme A, 0.46 | −19.4 | 2020 | 2037 | 73.6 | 78.8 |
| Celluclast ® 1.5 L, 0.46 | −10.4 | 2023 | 2020 | 70.5 | 78.4 |

The results clearly show that a large excess of the enzyme has a considerable adverse effect on the effectiveness of the retention aid polymer A with a simultaneous sharp increase in the COD in the white water (filtrate). As a result of the addition of the enzyme in a concentration of 0.46% by weight, large amounts of interfering substances are produced.

Without addition of the retention aid polymer A, the total retention effect (FPR) is substantially improved in the range of the low enzyme dose according to the invention. As a result of the addition of the retention aid polymer A in combination with the low enzyme dose according to the invention, an effect over and above this was found in the total retention (FPR).

EXAMPLE 5

A 6% strength by weight stock suspension comprising 100% waste paper (old corrugated container) was introduced into a 2 l beaker. The pH of the suspension was, if required, adjusted to pH 7.5 with an aqueous sodium hydroxide solution or hydrochloric acid. Thereafter, the amounts of enzyme A which are stated in Table 5 were added and stirred with the aid of a Heiltof stirrer at 250 rpm for one hour at 55° C. After this treatment, the stock suspension was diluted with water to a consistency of 2 g/l. 0.03% by weight of polymer A was optionally added to this dilute stock suspension with stirring. The drainage time was then determined; the results are summarized in Table 5.

TABLE 5

Improvement of the drainage time at various enzyme concentrations as a function of the addition of a polymeric retention aid

| Test No. | Enzyme A [% by weight] | Improvement of the drainage time [%], without addition of polymer A | Improvement of the drainage time [%], with addition of polymer A |
|---|---|---|---|
| 21 | 0 | — | 41.7 |
| 22 | 0.0001 | 27.4 | 51.2 |
| 23 | 0.0003 | 39.3 | 58.3 |

These results show the synergistic effect at a low enzyme dose according to the invention in combination with a cationic polymeric retention aid. At an enzyme dose of 0.003% by weight, the addition of the cationic polymeric retention aid results in an increase in the drainage performance of about 20%.

EXAMPLE 6

Example 5 was repeated but enzyme A was added only in an amount of 0.001% by weight. Furthermore, a fixing agent A, polymer A and a bentonite were optionally added. The drainage time was then determined; the results are summarized in Table 6.

TABLE 6

Improvement of drainage time as a function of the addition of a fixing agent, a polymeric retention aid and a bentonite

| Test No. | Enzyme A [% by weight] | Fixing agent A [% by weight] | Polymer A [% by weight] | Bentonite [% by weight] | Improvement of the drainage time [%] |
|---|---|---|---|---|---|
| 24 | 0 | 0 | 0 | 0 | — |
| 25 | 0.001 | 0 | 0 | 0 | 35.0 |
| 26 | 0 | 0.01 | 0 | 0 | 3.3 |
| 27 | 0.001 | 0.01 | 0 | 0 | 32.5 |
| 28 | 0 | 0 | 0.03 | 0 | 41.7 |
| 29 | 0 | 0.01 | 0.03 | 0 | 39.2 |
| 30 | 0.001 | 0.01 | 0.03 | 0 | 51.7 |
| 31 | 0 | 0.01 | 0.03 | 0.2 | 46.7 |
| 32 | 0.001 | 0.01 | 0.03 | 0.2 | 54.2 |

The results clearly show that the combination of enzyme in a low dose with a cationic polymeric retention aid as well as with a retention aid system comprising cationic polymer and inorganic microparticle component leads to a considerable improvement of the drainage.

EXAMPLE 7

A 4% by weight stock suspension comprising 100% waste paper (old corrugated container) was introduced into a 2l beaker. The pH of the stock suspension was, if required, adjusted to pH 7.5 with an aqueous sodium hydroxide solution or hydrochloric acid. Thereafter, the amounts of enzyme A which are stated in Table 7 were added and stirred with the aid of a Heiltof stirrer at 800 rpm for one hour at 55° C. After this treatment, the stock suspension was diluted with water to a consistency of 2 g/l. 0.03% by weight of polymer A was optionally added to this dilute stock suspension with stirring. The water retention value (WRV) was then determined; the results are summarized in Table 7.

TABLE 7

Water retention value at various enzyme concentrations as a function of the addition of a polymeric retention aid

| Test No. | Enzyme A [% by weight] | WRV without addition of polymer A [%] | WRV with addition of polymer A [%] |
|---|---|---|---|
| 33 | 0 | 116 | 112 |
| 34 | 0.001 | 103 | 98 |
| 35 | 0.005 | 99 | 101 |
| 36 | 0.01 | 101 | 99 |
| 37 | 0.05 | 102 | 102 |
| 38 | 0.1 | 104 | 98 |
| 39 | 0.3 | 103 | 101 |
| 40 | 0.5 | 102 | 101 |

The results show that the addition of the enzyme in a low dose leads to an improvement of the fiber modification.

The invention claimed is:

1. A process for the production of paper, board and cardboard, said process comprising:

draining a paper stock on a wire in the presence of at least one cationic polymeric retention aid and/or retention aid system with sheet formation; and drying the sheets, wherein an endo-β-1,4-glucanase is metered in an amount of from 0.00001 to 0.01% by weight, based on the dry paper stock, into the paper stock before the addition of the at least one cationic polymeric retention aid and/or retention aid system, wherein the cationic polymeric retention aid is selected from the group consisting of the polyacrylamides, polyethylenimines, polyvinylamines, polydimethyldiallylammonium chloride, and any mixtures thereof.

2. The process according to claim 1, wherein the endo-β-1,4-glucanase is metered in an amount of from 0.00001 to 0.005% by weight, based on the dry paper stock, into the paper stock.

3. The process according to claim 1, wherein the endo-β-1,4-glucanase is metered in an amount of from 0.00001 to 0.001% by weight, based on the dry paper stock, into the paper stock.

4. The process according to claim 1, wherein the endo-β-1,4-glucanase is metered into high-consistency paper stock.

5. The process according to claim 1, wherein the cationic polymeric retention aid is selected from the group consisting of the polyacrylamides and polyvinylamines.

6. The process according to claim 1, wherein the cationic polymeric retention aid is a linear, branched or crosslinked polyacrylamide.

7. The process according to claim 1, wherein the cationic polymeric retention aid is a branched or crosslinked polyacrylamide in the form of a salt or quaternization product of a cationic copolymer of acrylamide and an unsaturated cationic ethylene monomer which is selected from dimethylaminoethyl acrylate (ADAME), dimethylaminoethylacrylamide and dimethylaminoethyl methacrylate (MADAME).

8. The process according to claim 1, wherein the polyacrylamide has an intrinsic viscosity of at least 2 dl/g.

9. The process according to claim 1, wherein the polyvinylamine is a vinylamine homopolymer of N-vinylformamide having a degree of hydrolysis of from 1 to 100 mol % or a copolymer of N-vinylformamide and vinyl formate, vinyl acetate, vinyl propionate, acrylonitrile, methyl acrylate, ethyl acrylate and/or methyl methacrylate hydrolyzed to a degree of from 1 to 100 mol % and having K values of from 30 to 150.

10. The process according to claim 1, wherein the cationic polymeric retention aid is metered in an amount of from 0.001 to 0.1% by weight, based on the dry paper stock.

11. The process according to claim 1, wherein the retention aid system is a microparticle system comprising an inorganic component.

12. The process according to claim 11, wherein the inorganic component is selected from bentonite and silica gel.

13. A paper produced according to claim 1.

* * * * *